US008506431B2

(12) United States Patent
Green et al.

(10) Patent No.: US 8,506,431 B2
(45) Date of Patent: Aug. 13, 2013

(54) ARCHERY BROADHEAD

(75) Inventors: Kenneth P. Green, Lunenburg, VA (US); Daniel A. Summers, Monroe, VA (US)

(73) Assignee: Daniel A. Summers, Monroe, VA (US)

( * ) Notice: Subject to any disclaimer, the term of this patent is extended or adjusted under 35 U.S.C. 154(b) by 0 days.

(21) Appl. No.: 13/311,138

(22) Filed: Dec. 5, 2011

(65) Prior Publication Data

US 2012/0172159 A1 Jul. 5, 2012

Related U.S. Application Data

(60) Provisional application No. 61/419,514, filed on Dec. 3, 2010.

(51) Int. Cl.
*F42B 6/08* (2006.01)

(52) U.S. Cl.
USPC ..... 473/584

(58) Field of Classification Search
USPC ..... 473/582, 583, 584
See application file for complete search history.

(56) References Cited

U.S. PATENT DOCUMENTS

| | | | | |
|---|---|---|---|---|
| 4,210,330 | A | 7/1980 | Kosbab | |
| 4,570,941 | A * | 2/1986 | Saunders | 473/584 |
| 4,807,889 | A * | 2/1989 | Johnson | 473/584 |
| RE34,397 | E * | 10/1993 | DelMonte et al. | 473/584 |
| 5,636,846 | A | 6/1997 | Tinsley | |
| 7,011,589 | B2 * | 3/2006 | Davis | 473/584 |
| 7,708,659 | B2 * | 5/2010 | Grace, Jr. | 473/584 |
| 8,096,905 | B1 * | 1/2012 | Gillig | 473/584 |
| 2006/0178238 | A1 * | 8/2006 | Davis | 473/583 |

* cited by examiner

*Primary Examiner* — John Ricci
(74) *Attorney, Agent, or Firm* — Hiscock & Barclay, LLP

(57) ABSTRACT

A broadhead arrow having a body and at least two removable blades attached to the body. The blades being locked into a place by a lock washer that slides over the rear portion of the body and is secured between the broadhead point and the arrow shaft. Removal of the washer allows for easy removal and replacement of the blades.

18 Claims, 6 Drawing Sheets

Section A–A

ARCHERY BROADHEAD

CROSS-REFERENCE TO RELATED APPLICATIONS

This application claims the benefit of U.S. Provisional Patent Application Ser. No. 61/419,514 filed Dec. 3, 2010, the specification of which is hereby incorporated by reference in its entirety.

FIELD OF THE INVENTION

This invention relates to archery arrow tips, and more particularly to archery broadhead arrow tips.

BACKGROUND OF THE INVENTION

Broadheads are often used by bow hunters while hunting large game animals. The broadhead generally has two or more sharp blades extending from the point. The blades form a wide cutting edge that cause massive bleeding once striking the target.

Broadheads are used in hunting popular big game animals such as deer, elk, antelope, bear, and elephants. The broadhead promotes internal bleeding upon impact as opposed to the shock or concussion produced by a rifle bullet.

Broadheads must be designed such that they can penetrate the hide, and in some circumstances, the bone of the target animal. Ideally, the hunter will aim for the lungs, or other vital organs of the animal to achieve a fast kill. The extended blades of the broadhead provide a large cutting surface to quickly bring down the target animal.

There are two main types of broadheads used today, mechanical broadheads and fixed-blade broadheads. Mechanical broadheads deploy the blades upon contact with the target. Mechanical broadheads are more streamlined in flight but are less effective at penetrating the target as a portion of the impact energy is absorbed to deploy the blades.

Fixed-blade broadheads have blades that are fixed into the open position. While sacrificing some flight characteristics, fixed-blade broadhead cut on impact in a much more efficient manner than mechanical broadheads. The blade creates a better wound channel for blood flow improving the likelihood of developing a good blood trail. The fixed-blade broadhead generally cuts deeper because it does not loose energy in the process of opening the blades as is common with mechanical broadheads. Fixed-blade broadheads are also stronger than comparable mechanical broadheads as there are no moving part. For these reasons fixed-blade broadheads are preferred by most hunters.

The blades occasionally become damaged thereby making the broadhead unusable. Sticking a hard object such as a tree, rock or even some bones can deform the broadhead blade. Shooting a deformed broadhead can result in erratic arrow flight. Shooters may have preference for distinct blade styles depending on the conditions. Also in certain jurisdictions, particular designs are prohibited.

Therefore, a broadhead having replaceable blades is desired.

SUMMARY OF THE INVENTION

The invention comprises, in one form thereof, a broadhead having removable blades. The removable blades fit into a series of recessed portion found in the broadhead body and are locked into place with a locking device such as a lock washer. The locking device is held between the tip and the arrow shaft. The inner diameter of the locking device retains the removable blades to the body.

More particularly, the invention includes a broadhead having a body with an axis, a threaded portion and a blade recess; a tip at a first end of the body; at least two removable blades having a cutting edge, a base and a blade lock, the base being fashioned to fit within the blade recess; and a lock washer having an inner bore sufficient to slide over the threaded portion and the base positioned in the blade recess to affix the removable blades to the body.

The invention includes many optional components listed in this paragraph. For example, the body may contain a washer stop to limit travel of the lock washer. Additionally, the blade recess may extend from the threaded portion and through the washer stop. Optionally, the tip has at least two tip blades that terminate at a common point. The tip blades may make a smooth transition to the removable blades. The tip may be removable or may be integrated into the housing body. A large portion of the total mass of the removable blades is located behind the rear portion of the lock washer, that is the end away from the tip. This may be at least 50% of the total mass of the removable blade and may also be at least 75% of the total mass. Optionally, the removable blades have a relatively steep angle and may be between 25 and 50 degrees relative to the axis of the body; in one embodiment the angle may also be more narrowly defined between 32 and 43 degrees. The removable blades may also contain a rear edge extending from the end of the cutting edge to a blade opening, the blade opening allowing the locking device to travel between the base and the cutting edge. The rear edge may extend substantially orthogonal to the axis of the body. The broadhead may have 2, 3, 4, 5 or 6 removable blades with 3 removable blades being the most common configuration. Optionally, when placing the removable blades into the blade recess, the blade lock on the removable blade aligns with the washer stop on the body to form a continuous edge along the circumference of the body.

The broadhead has a short overall length. This better aligns the concentricity ferrule axis with the shaft axis. The shorter length improves arrow flight and reduces the arrow fletching profile.

In another form, the invention includes a removable blade having a cutting edge with a blade angle; a base and a blade opening beginning at the end of the base and extending to a blade lock. Optionally, the removable blade may contain any of the features discussed above.

In yet another form, the invention includes a broadhead body having an axis with a first and second end; a treaded portion at the first end; a blade recess for receiving removable broadhead blades and a washer stop to limit travel of a locking device. Optionally, the broadhead body may contain any of the features discussed above.

In another form, the invention includes a method for assembling a broadhead. The method comprises the steps of providing a body having an axis, a threaded portion and a blade recess; inserting at least two removable blades comprising a cutting edge, a base and a blade lock, into the blade recess; and securing a lock washer over the threaded portion and the base positioned in the blade recess to affix the removable blades to the body.

An advantage of the present invention is that the blades are easily removable.

A further advantage of the present invention is that the by positioning more mass away from the tip, the arrow flight is more predictable.

An even further advantage of the present invention is that a shorter overall length of the broadhead allows the arrow flight to be similar to a field or practice point.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
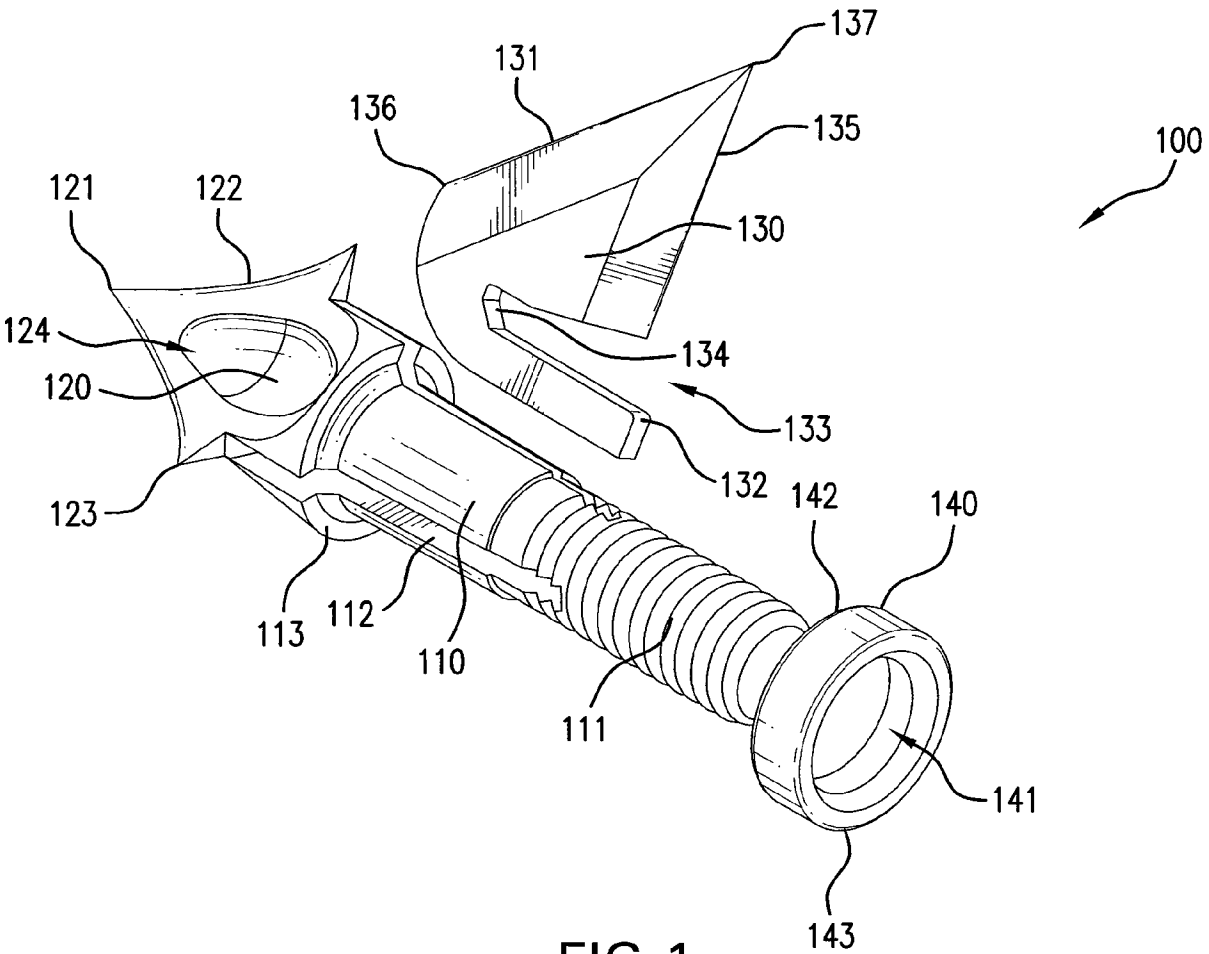
FIG. 1 is an exploded isometric view of broadhead having removable blades according to one embodiment.

Referring to FIGS. 1 and 2A-2D, there is shown a broadhead according to one embodiment. The broadhead 100 includes a body 110, a tip 120, removable blades 130, and a lock washer 140.

The broadhead body 110 has a threaded portion 111 proximate the rear end of the body 110. The threaded portion 111 threads into an arrow shaft to attach the broadhead to the arrow. The broadhead body may be made from any suitable material such as, but not limited to stainless steel, carbon steel, aluminum, metals, ceramics and alloys.

The broadhead body further contains a number of blade recesses 112. Generally the number of blade recesses corresponds to the number of blades attached to the body. However, it is understood that the body may contain more recesses to accommodate a wider variety of blade choices. For example, the body may contain six blade recesses but the user may only insert three blades into the body. Most common the broadhead body has between two and six blade recesses. In one embodiment, the body 110 has three blade recesses 112.

The blade recesses 112 extend parallel along the axis of the body 110. In one embodiment, the blade recess extends into the threaded portion 111 to allow a portion of the removable blade 120 to extend into the arrow shaft (not shown). This provides additional rigidity to the blade upon impact. Thereby decreasing the likelihood of a blade becoming detached.

In embodiments where a tip 120 is integrated with the body 110, the body 110 further contains a washer stop 113. The washer stop 113 limits travel of a locking mechanism such as a lock washer 140. In one embodiment, the blade recesses 112 extend through the washer stop 113, and they may even extend into the tip.

The tip 120 has a point 121 with a number of tip blades 122 extending from the point towards the rear of the tip 120. Preferably, the tip 120 is integrated with the body 110 as a single component. However, it is understood that a removable tip may be used to allow further customization by the end user. The tip blades 122 terminate and form a rear seat 123. When inserted, the leading edge 136 of the removable blade 130 abuts the rear seat 123 to form a continuous cutting surface from the point 121 to the trailing edge 137. Preferably, the number of tip blades 122 correlates with the number of removable blades 130. In one embodiment, the tip 120 has three tip blades 122. Optionally, the tip 120 further contains depressions 124 or other design features to improve the flight characteristics or aesthetic properties of the broadhead.

The removable blades 130 contain a sharpened cutting edge 131 having a leading edge 136 and a trailing edge 137. The blade base 132 is inserted into the blade recess 112 such that the top portion of the blade base 132 remains flush with the body 110. The blade opening 133 proves a gap between the cutting surface 131 and the blade base 132. Once inserted, the inner bore 141 of the lock washer 140 slides over the blade base 132 into the blade opening 133. The front portion 142 of the lock washer 140 abuts the blade lock 134 of the removable blade 130 and the washer stop 113 of the body 110 to affix the removable blade 130 to the body 110. In one embodiment, the washer stop 113 and the blade lock 134 form a continues edge along the circumference of the body 110. The blade base 132 rests inside of the arrow shaft further securing the removable blade 130. In one embodiment, the blade base is at least 3/32" long; in another embodiment, the blade base is at least 1/8" long; in yet another embodiment, the blade base is at least 1/4" long; and in a further embodiment, the blade base extends rearward beyond the plane defined by the trailing edge of the removable blade.

To improve flight characteristics of the arrow, the center of mass for the removable blade 130 is moved behind the blade lock 134 towards the trailing edge 137. This provides an aerodynamic advantage and less wobble during arrow flight. Normal broad head changes the overall effective length of the arrow shaft bringing more mass "front of center." The shorter broadhead more closely represents the trajectory of field or practice points and further reduces concentricity tolerance. When assembled to an arrow shaft, the cutting edge 131 overhangs the arrow shaft (not show). In one embodiment, at least 50% of the removable blade's 130 mass is located behind the rear portion 143 of the lock washer 140 when assembled. In another embodiment, at least 70% of the removable blade's 130 mass is located behind the rear portion 143 of the lock washer 140 when assembled.

Optionally, the removable blade 130 further contains a rear edge 135. In one embodiment, the rear edge 135 is sharpened to a form a cutting surface. The rear cutting surface makes it easier to remove the broadhead by cutting through any obstructions. Alternatively, the rear edge 135 may be a smooth surface or contain a barbed design.

When affixed to the body 110, the removable blades 130 provide a continuous cutting surface from the point 121 along the tip blade 122 and the cutting edge 131 to the trailing edge 137. In one embodiment, taking the cutting surface from the point 121 to the trailing edge 137, the cutting surface has an angle between 25 and 50 degrees relative to the center axis of the body 110. In another embodiment, the cutting surface has an angle between 30 and 45 degrees relative to the center axis of the body 110. In further embodiment, the cutting surface has an angle between 35 and 40 degrees relative to the center axis of the body 110. The cutting surface may be linear from the point 121 to the trailing edge 137 or it may be slightly curved.

As discussed above, the lock washer 140 affixes the removable blades 130 to the body 110. The front portion 142 abuts the blade lock 134 and when the body 110 is screwed into an arrow shaft (not shown), the arrow shaft presses against the rear portion 143 of the lock washer 140. The lock washer 140 is effectively positioned between the blade lock 134 and the end of the arrow shaft (not shown) to prevent movement. It is understood that although a lock washer is described herein, that other suitable locking devices are envisioned. For example, the threaded portion on the body may extend to the washer stop to allow for the connection of a threaded nut. Furthermore, the locking device may be shaped to correlate with the washer stop of the arrow shaft to provide a more reliable fit.

Referring to FIGS. 3A-3D, there is shown a broadhead design according to another embodiment. The broadhead contains a body 110, tip 120 and lock washer 140 as described above. The removable blades 230 are similar to those shown in FIGS. 1 and 2A-2D with the exception of the rear edge 235. The rear edge 235 provides a more streamlined design which may be desirable. However, this design may not be permitted in all jurisdictions. Additionally, the removable blades 330 contain less material, thereby allowing for a lighter overall weight. It is understood that the optional features and alternative embodiments discussed above may further apply to this embodiment.

Figure 4A:
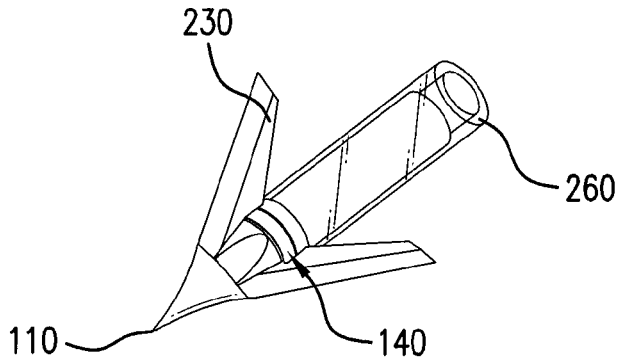
FIG. 4A is an isometric view of the broadhead according to one embodiment.
Figure 4B:
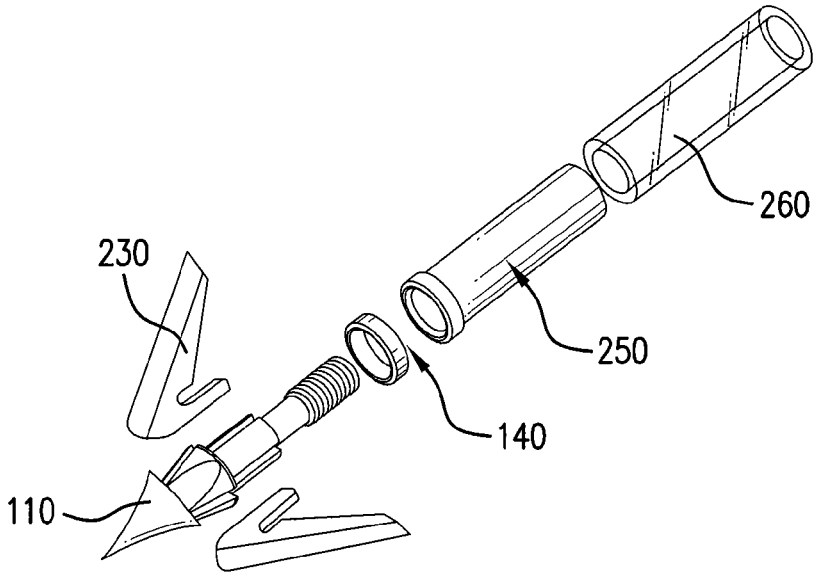
FIG. 4B is an exploded isometric view of the broadhead shown in FIG. 4A.

Referring to FIGS. 4A-4B, there is shown a broadhead design utilizing an insert. The body 110 is screwed into an insert 250. The insert 250 is housed inside the end of the arrow 260. As the body 110 is screwed into the insert 250 the lock washer 140 is sandwiched between the insert 250 and the body 110, thereby locking the removable blades 230 in place. In an alternative embodiment, the broadhead design does not include a lock washer. Instead, the insert or arrow shaft is used to lock the removable blades in place.

Figure 5A:
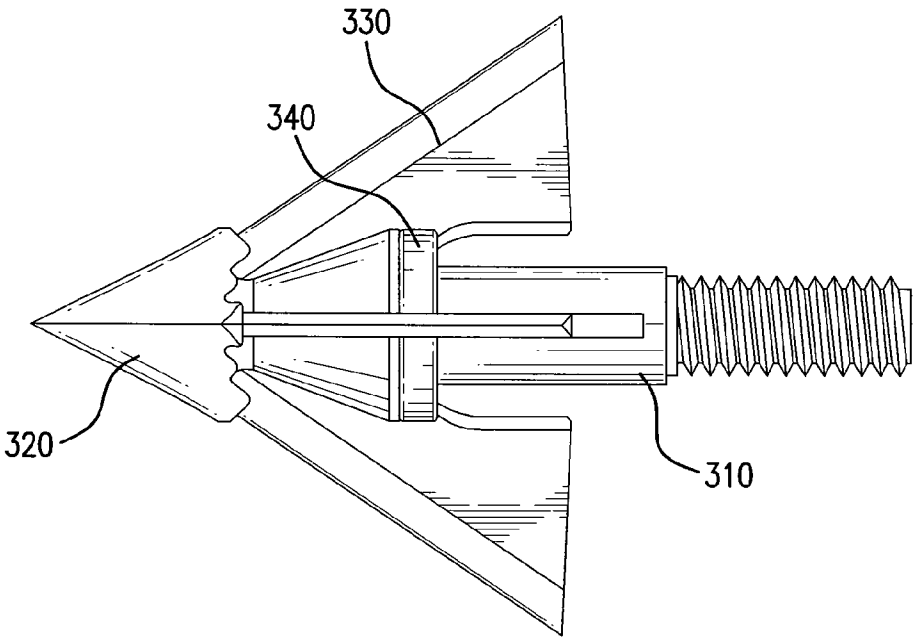
FIG. 5A is a side view of an assembled broadhead according to one embodiment.
Figure 5B:
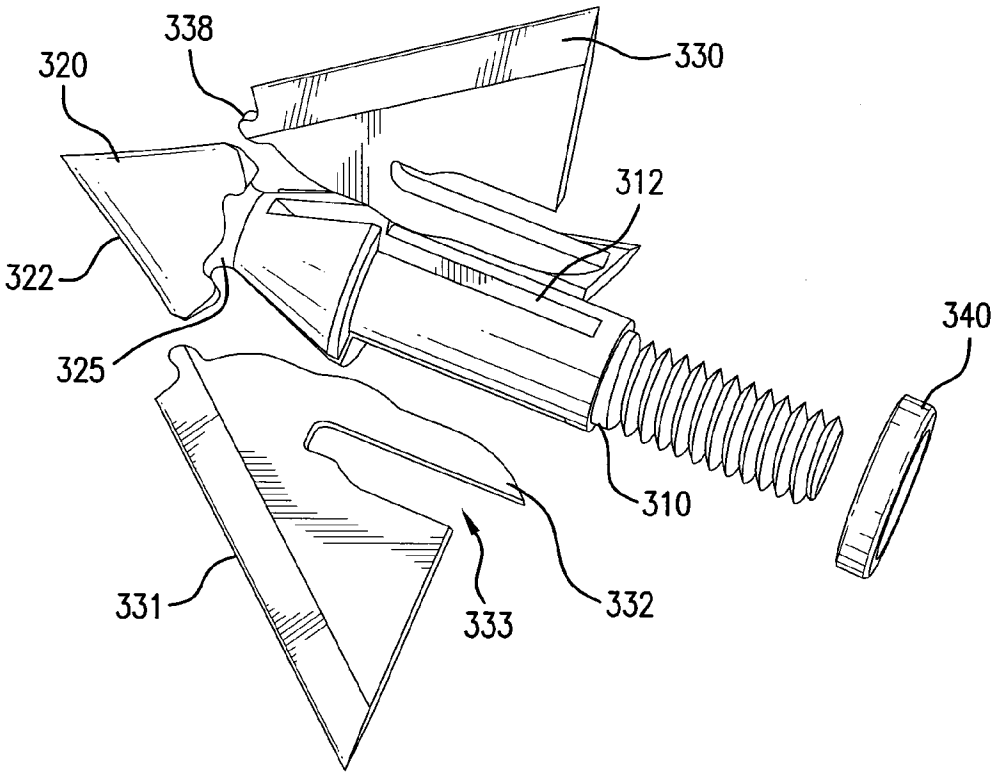
FIG. 5B is an exploded isometric view of the broadhead shown in FIG. 5A.

Referring to FIGS. 5A-5B, there is shown a broadhead design according to another embodiment. The tip 320 is a portion of the body 310. The blade base 332 of the removable blades 330 fits into the blade recess 312. To provide additional support, the front blade tab 338 fits into the notch 325. To provide additional support, a rear blade tab 339 may be used to lock the blade base 330 into a rear portion of the blade recess 312. In one embodiment, the blade base 332 is shaped to correspond to the internal shape of the blade recess 312 to ensure a secure connection. As in the embodiments described above, a lock washer 340 slides over the blade base 332 and into the blade opening 333 to secure the removable blades 330 to the body 310. When threaded into an arrow shaft, the end of the arrow shaft presses against the lock washer 340 and secures the removable blades 330. When assembled the tip blade 322 and the blade cutting edge 331 are in the same plane. The blade cutting edge 331 terminating below the rearmost edge of the tip blade 322 to prevent the removable blade from catching upon impact.

Figure 2A:
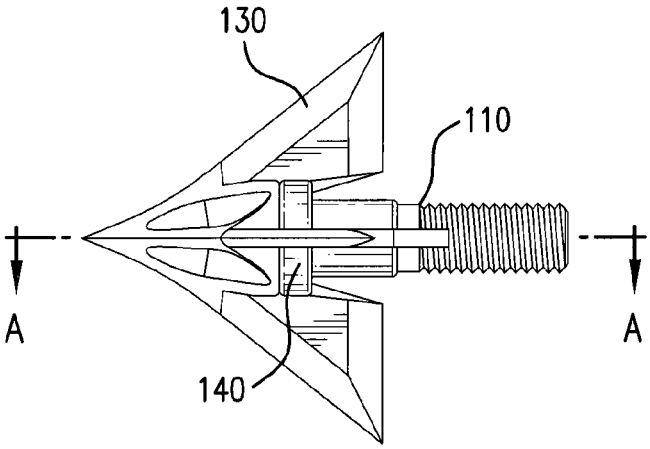
FIG. 2A is a side view of the assembled broadhead shown in FIG. 1.
Figure 2B:
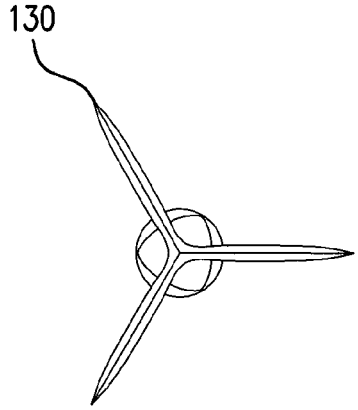
FIG. 2B is a front view of the assembled broadhead shown in FIG. 1.
Figure 2C:
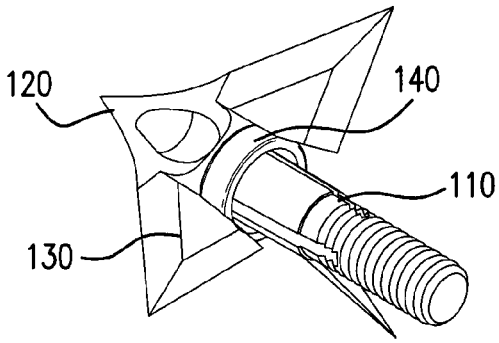
FIG. 2C is an isometric view of the assembled broadhead shown in FIG. 1.
Figure 2D:
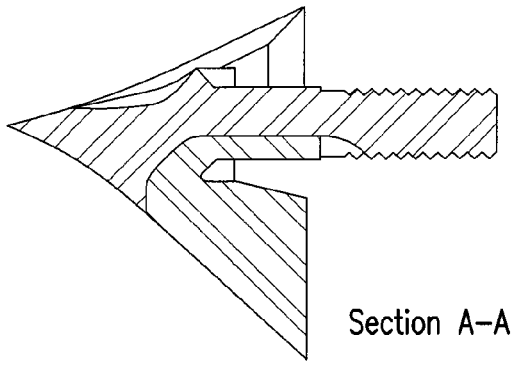
FIG. 2D is a cross sectional view of the broadhead shown in FIG. 2A taken across line A-A.
Figure 3A:
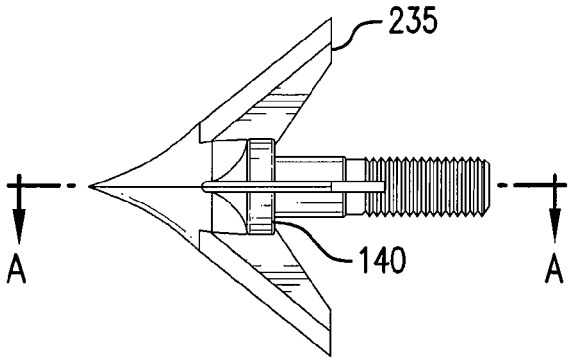
FIG. 3A is a side view of an assembled broadhead according to another embodiment.
Figure 3B:
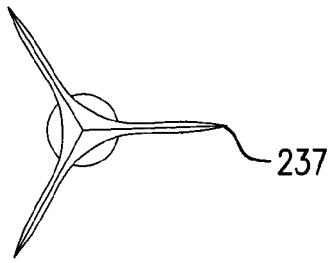
FIG. 3B is a front view of the broadhead shown in FIG. 3A.
Figure 3C:
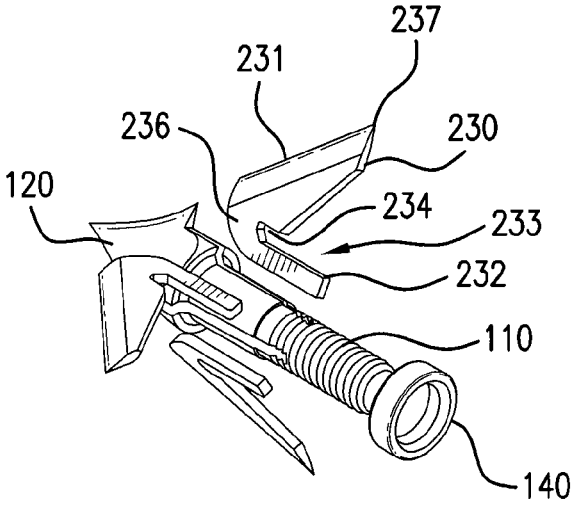
FIG. 3C is an exploded isometric view of the broadhead shown in FIG. 3A.
Figure 3D:
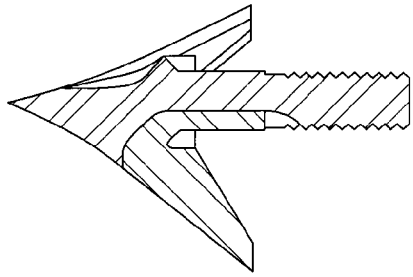
FIG. 3D is a cross sectional view of the broadhead shown in FIG. 3A taken across line A-A.

In use, the broadhead may take on various shapes and sizes depending on the application. In one embodiment, the circumference of the broadhead measured along the circle formed by the trailing edge 137 of the removable blades 130 as shown in FIG. 2B is between 1.00 and 1.50 inches. More preferably, the circumference is between 1.20 and 1.30 inches. The distance from the point 121 to the trailing edge 137 is between 0.65 and 1.25 inches. In another embodiment, the distance from the point 121 to the trailing edge 137 is between 0.65 and 1.00 inches. In yet another embodiment, the distance from the point 121 to the trailing edge 137 is between 0.70 and 1.10 inches. The total length of the body from the tip to the rear end is between 1.25 and 1.85 inches. In another embodiment, the total length of the body from the tip to the rear end is between 1.40 and 1.75 inches. When installed, the distance from the tip to the front of the arrow shaft is less than 0.85 inches, preferable less than 0.75 inches and more preferable less than 0.70 inches. The distance horizontal along the axis from the leading edge 136 to the trailing edge 137 is between 0.70 and 1.10 inches. The length of the threaded portion is between 0.50 and 0.70 inches. The distance from the rear edge of the washer to the end of the threaded portion is between 0.60 and 0.80 inches. While these dimensions are provided for particular embodiments, it is understood that they are merely exemplary and are not intended to be limiting.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention. For example, while a three blade design is shown in the FIGS. 2, 4, 5 and 6 blade designs are envisioned. Furthermore, the locking mechanism described above may be utilized for mechanical broadheads.

Therefore, it is intended that the invention not be limited to the particular embodiments disclosed as the best mode contemplated for carrying out this invention, but that the invention will include all embodiments falling within the scope and spirit of the appended claims.

PARTS LIST

100 Broadhead
110 Body
111 Threaded Portion
112 Blade Recess
113 Washer Stop
120 Tip
121 Point
122 Tip Blade
123 Rear Seat
124 Depression
130 Removable Blade
131 Blade Cutting Edge
132 Blade Base
133 Blade Opening
134 Blade Lock
135 Rear Edge
136 Leading Edge
137 Trailing Edge
140 Lock Washer
141 Inner Bore
142 Front Portion
143 Rear Portion
230 Removable Blade
231 Blade Cutting Edge
232 Blade Base
233 Blade Opening
234 Blade Lock
235 Rear Edge
236 Leading Edge

237 Trailing Edge
240 Lock Washer
250 Insert
260 Arrow
310 Body
312 Blade Recess
320 Tip
322 Tip Blade
325 Notch
330 Removable Blade
331 Blade Cutting Edge
332 Blade Base
333 Blade Opening
338 Front Blade Tab
339 Rear Blade Tab
340 Lock Washer

The invention claimed is:

1. A broadhead comprising:

a body comprising an axis, a threaded portion and at least two blade recesses;

a tip at a first end of said body;

at least two removable blades comprising a cutting edge having a leading edge and a trailing edge, a blade base and a blade lock with a blade opening, said base being fashioned to fit within said blade recess; and a lock washer comprising an inner bore sized to slide over said threaded portion and said blade base positioned in said blade recess to affix said removable blades to said body, said lock washer being positioned in advance of said trailing edge, wherein at least 50% of the removable blade's mass is located behind the blade lock towards said blade opening.

2. The broadhead of claim 1 wherein said body further comprises a washer stop to limit travel of the lock washer.

3. The broadhead of claim 2 wherein said blade recess extends from said threaded portion and through said washer stop.

4. The broadhead of claim 1 wherein said tip comprises three tip blades terminating at a common point.

5. The broadhead of claim 4 wherein said tip blades form a smooth transition to said removable blades.

6. The broadhead of claim 1 wherein said tip is removable.

7. The broadhead of claim 1 wherein said tip is integrated into the body.

8. The broadhead of claim 1 wherein at least 75% of the total mass of said removable blades is located behind a rear portion of said lock washer away from said tip.

9. The broadhead of claim 1 wherein said cutting edge extends at an angle between 25 and 50 degrees relative to the axis of said body.

10. The broadhead of claim 1 wherein said cutting edge extends at an angle between 30 and 45 degrees relative to the axis of said body.

11. The broadhead of claim 1 wherein said removable blades further comprise a rear edge extending from the end of the cutting edge to the blade opening, the blade opening allowing the lock washer to travel between said base and said cutting edge.

12. The broadhead of claim 11 wherein said rear edge extends substantially orthogonal to the axis of said body.

13. The broadhead of claim 1 wherein said tip further comprises a notch and said at least two removable blades further comprise a blade tab that locks into said notch to secure said at least two removable blades to said body.

14. The broadhead of claim 13 wherein said at least two removable blades further comprise a rear blade tab that slide into and lock the blade base into a rear portion of the blade recess.

15. A broadhead assembly comprising:

a removable blade comprising:

a cutting edge having a blade angle;

a base; and a blade opening beginning at the end of said base and extending to a blade lock, wherein at least 50% of the removable blade's mass is located behind the blade lock towards said blade opening.

16. The broadhead assembly of claim 15 further comprising a body comprising:

an axis having a first and second end;

a threaded portion at the first end of said axis;

a blade recess for receiving removable broadhead blades; and a washer stop to limit travel of a lock washer.

17. The broadhead assembly of claim 16 wherein said body further comprising a tip at the second end of said axis.

18. A method for assembling a broadhead comprising the steps of:

providing a body having an axis, a threaded portion and a blade recess;

inserting at least two removable blades comprising a cutting edge, a base and a blade lock with an elongated blade opening, into said blade recess; and securing a lock washer over said threaded portion and said base positioned in said blade recess to affix said removable blades to said body, wherein, once assembled, a portion of the elongated blade opening extends over the body and past the lock washer to provide a clearance that reduces a rearward mass of the blade.

* * * * *